US011845159B2

(12) United States Patent
Hamamatsu et al.

(10) Patent No.: US 11,845,159 B2
(45) Date of Patent: Dec. 19, 2023

(54) CENTER SHAFT MACHINING APPARATUS

(71) Applicant: HONDA MOTOR CO., LTD., Tokyo (JP)

(72) Inventors: Shinya Hamamatsu, Tokyo (JP); Kazunari Inamori, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 51 days.

(21) Appl. No.: 17/589,099

(22) Filed: Jan. 31, 2022

(65) Prior Publication Data

US 2022/0266405 A1 Aug. 25, 2022

(30) Foreign Application Priority Data

Feb. 24, 2021 (JP) ..... 2021-027246

(51) Int. Cl.

| | |
|---|---|
| ***B24B 5/06*** | (2006.01) |
| ***B24B 5/08*** | (2006.01) |
| ***B24B 5/14*** | (2006.01) |
| ***B24B 5/35*** | (2006.01) |
| ***B24B 41/02*** | (2006.01) |

(Continued)

(52) U.S. Cl.

CPC ..... *B24B 5/08* (2013.01); *B24B 5/14* (2013.01); *B24B 5/185* (2013.01); *B24B 5/35* (2013.01); *B24B 5/40* (2013.01); *B24B 19/12* (2013.01); *B24B 33/02* (2013.01); *B24B 41/06* (2013.01); *B24B 41/061* (2013.01); *B24B 41/02* (2013.01)

(58) Field of Classification Search

CPC .... B24B 5/02; B24B 5/06; B24B 5/08; B24B 5/14; B24B 5/18; B24B 5/185; B24B 5/24; B24B 5/35; B24B 5/40; B24B 33/02; B24B 33/025; B24B 41/02; B24B 41/06; B24B 41/061; B24B 41/062; B24B 41/067; B24B 49/10; B24B 49/12; B23Q 3/18; B23Q 3/183; B23Q 3/186

USPC ..... 451/5, 6, 51, 180, 242, 246, 251, 397, 451/398, 400

See application file for complete search history.

(56) References Cited

U.S. PATENT DOCUMENTS 2,784,534 A * 3/1957 Townsend ..... B24B 41/061 451/244

FOREIGN PATENT DOCUMENTS

| | | |
|---|---|---|
| JP | S47-1191 U | 1/1972 |
| JP | S6411865 B2 | 2/1989 |

(Continued)

OTHER PUBLICATIONS

Office Action received in corresponding Japanese application No. 2022-027246 dated Sep. 6, 2022 with English translation (3 pages).

*Primary Examiner* — Eileen P Morgan

(74) *Attorney, Agent, or Firm* — Rankin, Hill & Clark LLP

(57) ABSTRACT

A center shaft machining apparatus includes: a grinding structure that moves on a machining central axis while rotating about the machining central axis and machines an end surface on one end side of a workpiece arranged on the machining central axis; an end portion support structure that supports an opposite end side of the workpiece; and a shaft portion support structure that supports a shaft support portion set at an intermediate portion of the workpiece. The end portion support structure includes an eccentric mechanism capable of supporting an opposite end of the workpiece in a state where a workpiece central axis of the workpiece is eccentric with respect to the machining central axis.

6 Claims, 9 Drawing Sheets

(51) Int. Cl.

| | |
|---|---|
| ***B24B 5/40*** | (2006.01) |
| ***B24B 33/02*** | (2006.01) |
| ***B24B 41/06*** | (2012.01) |
| ***B24B 49/12*** | (2006.01) |
| ***B24B 19/12*** | (2006.01) |
| ***B24B 5/18*** | (2006.01) |

(56) References Cited

FOREIGN PATENT DOCUMENTS

| | | | | |
|---|---|---|---|---|
| JP | H0947908 | A | * | 2/1997 |
| JP | 2006315153 | A | * | 11/2006 |
| JP | 5799118 | B2 | * | 10/2015 |
| JP | 5799118 | B2 | | 10/2015 |

* cited by examiner

CENTER SHAFT MACHINING APPARATUS

CROSS-REFERENCE TO RELATED APPLICATION

This application claims the benefit of foreign priority to Japanese Patent Application No. 2021-027246, filed on Feb. 24, 2021, which is incorporated by reference in its entirety.

TECHNICAL FIELD

The present invention relates to a center shaft machining apparatus that performs center hole machining of a workpiece.

BACKGROUND

A heat treatment is generally performed on a shaft workpiece (workpiece) such as a pulley shaft constituting a continuously variable transmission (CVT) in order to increase the strength of the shaft workpiece. However, the heat treatment may disadvantageously cause shaft workpieces to be distorted, and some products are out of tolerance (0.1 mm) and thus not allowed as products.

Japanese Patent Publication No. 64-11865 proposes a method of eliminating distortion by repeated pressing.

However, according to the method of correcting distortion as disclosed in Japanese Patent Publication No. 64-11865, a crack or a chap may be generated if a shaft workpiece is hollow.

The present invention has been made in view of the above, and an object thereof is to provide a center shaft machining apparatus capable of optimizing a center hole of a workpiece without generating a crack or a chap and capable of making a workpiece that is slightly out of tolerance fall within the tolerance.

SUMMARY

To address the above problem, one aspect of the present invention provides a center shaft machining apparatus comprising: a grinding structure that moves on a machining central axis while rotating about the machining central axis and machines an end surface on one end side of a workpiece arranged on the machining central axis; an end portion support structure that supports an opposite end side of the workpiece; and a shaft portion support structure that supports a shaft support portion set at an intermediate portion of the workpiece, wherein the end portion support structure includes an eccentric mechanism capable of supporting an opposite end of the workpiece in a state where a workpiece central axis of the workpiece is eccentric with respect to the machining central axis.

According to the present invention, it is possible to provide a center shaft machining apparatus capable of optimizing a center hole of a workpiece without generating a crack or a chap and capable of making a workpiece that is slightly out of tolerance fall within the tolerance.

DETAILED DESCRIPTION

Figure 1:
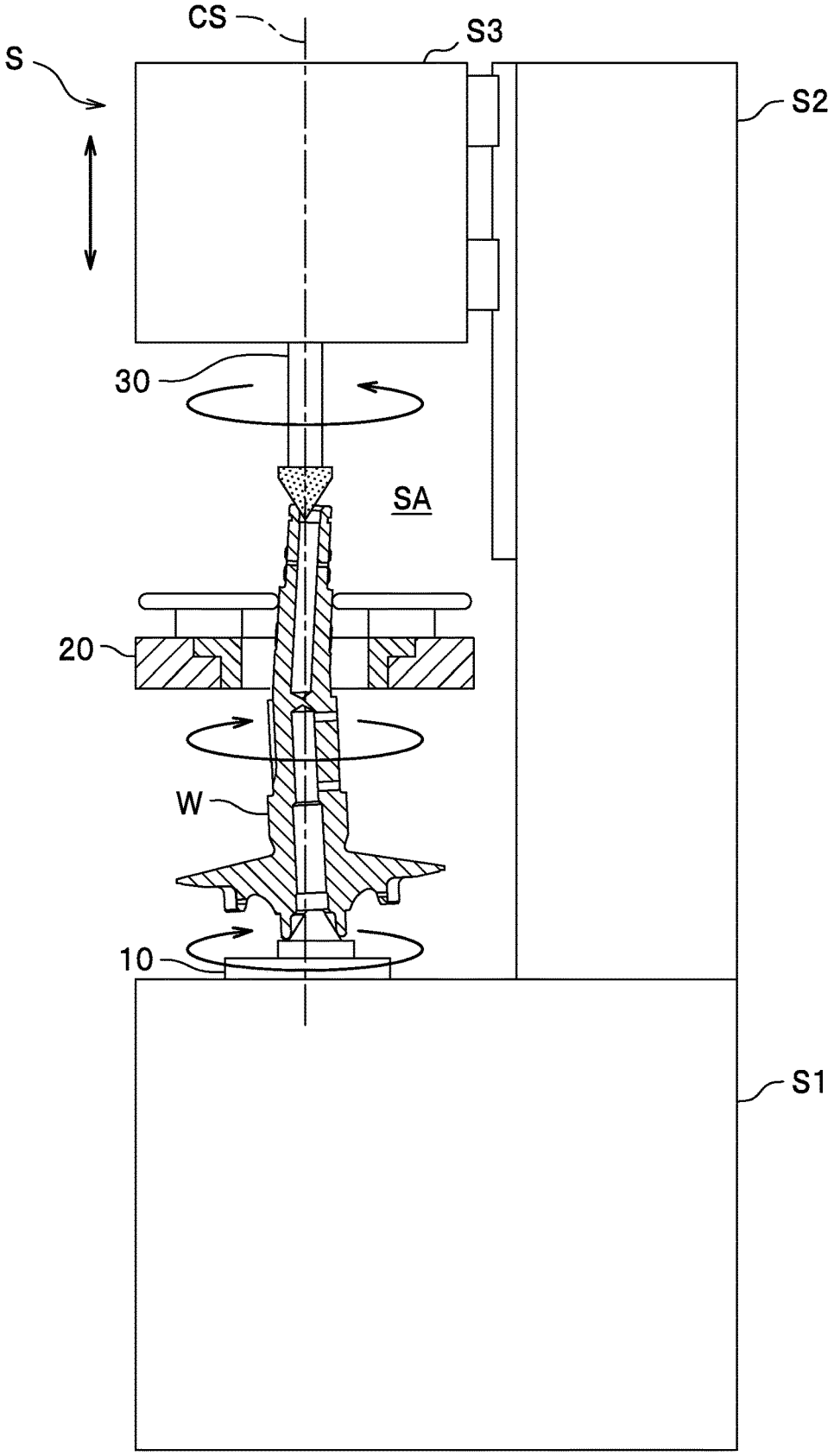
FIG. 1 is a side view illustrating an overview of a center shaft machining apparatus according to the present embodiment.

Hereinafter, a center shaft machining apparatus S according to one embodiment of the present invention will be described in detail with reference to FIGS. 1 to 12.

In the description, the same elements are denoted by the same reference numerals, and a redundant description will be omitted.

The center shaft machining apparatus S according to the present embodiment is mainly used in a process of reconstructing an end surface of a shaft portion of a workpiece (see FIG. 1).

The workpiece according to the present embodiment is mainly a shaft workpiece W such as a pulley shaft constituting a continuously variable transmission (CVT).

Therefore, the shaft workpiece W will be described, and then the center shaft machining apparatus S will be described.

Figure 2:
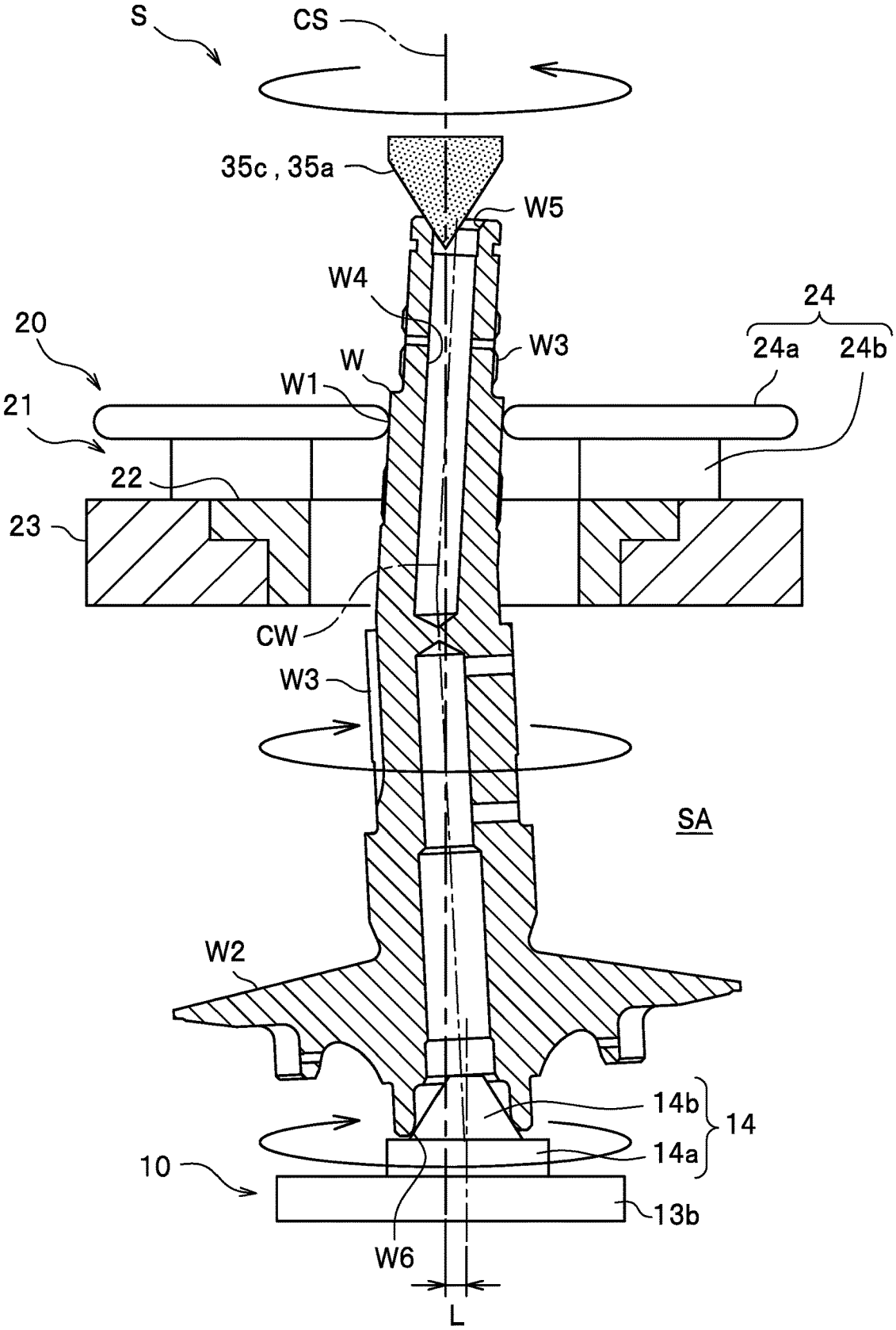
FIG. 2 is an enlarged cross-sectional view of main parts illustrating how an upper end surface of a shaft workpiece is reconstructed.

As illustrated in FIG. 2, the pulley shaft as the shaft workpiece W is constituted with a rotating body centered around a workpiece central axis CW.

In the shaft workpiece W, a shaft support portion W1, a pulley portion W2, a spline portion W3, and a center hole W4 are formed along a workpiece central axis CW.

The shaft support portion W1 has substantially a columnar shape and is a portion rotatably supported by a transmission case (not shown) of a transmission (not shown) or the like via a bearing (not shown) or the like.

The pulley portion W2 has substantially a conical shape and is a portion that transmits power to a transmission belt (not shown) while changing a reduction ratio together with a movable-side pulley (not shown).

The spline portion W3 is a portion with which the movable-side pulley can mesh, and which enables the movable-side pulley to move along the axial direction of the workpiece central axis CW and restricts rotation about the workpiece central axis CW.

The center hole W4 is formed for reducing the weight of the pulley shaft and as a path for supplying lubricating oil to the spline portion W3.

The center hole W4 is perforated along the workpiece central axis CW.

An opening W5 of the center hole W4 is formed in a conical shape.

Next, the center shaft machining apparatus S will be described (see FIG. 1).

The center shaft machining apparatus S mainly includes a bed S1, a column S2, and a head S3.

An end portion support structure 10, a shaft portion support structure 20, and a grinding structure 30 are arranged in the bed S1, the column S2, and the head S3, respectively.

The bed S1 has a structure serving as a base of the center shaft machining apparatus S.

The column S2 has a structure for allowing the head S3 to move up and down and reciprocate in the horizontal direction, and is formed in a columnar shape and erected on the bed S1.

The head S3 has a structure for actually machining the shaft workpiece W, and is provided with a grinding tool, a cutting tool, and the like.

In the center shaft machining apparatus S, a machining central axis CS is set along the vertical direction as a rotation axis of the rotating grinding tool and cutting tool.

In addition, the machining central axis CS is also a rotation axis at the time of performing grinding machining and cutting machining while rotating the shaft workpiece W.

A region surrounded by the bed S1, the column S2, and the head S3 is set as a machining space SA for machining the shaft workpiece W.

Figure 8:
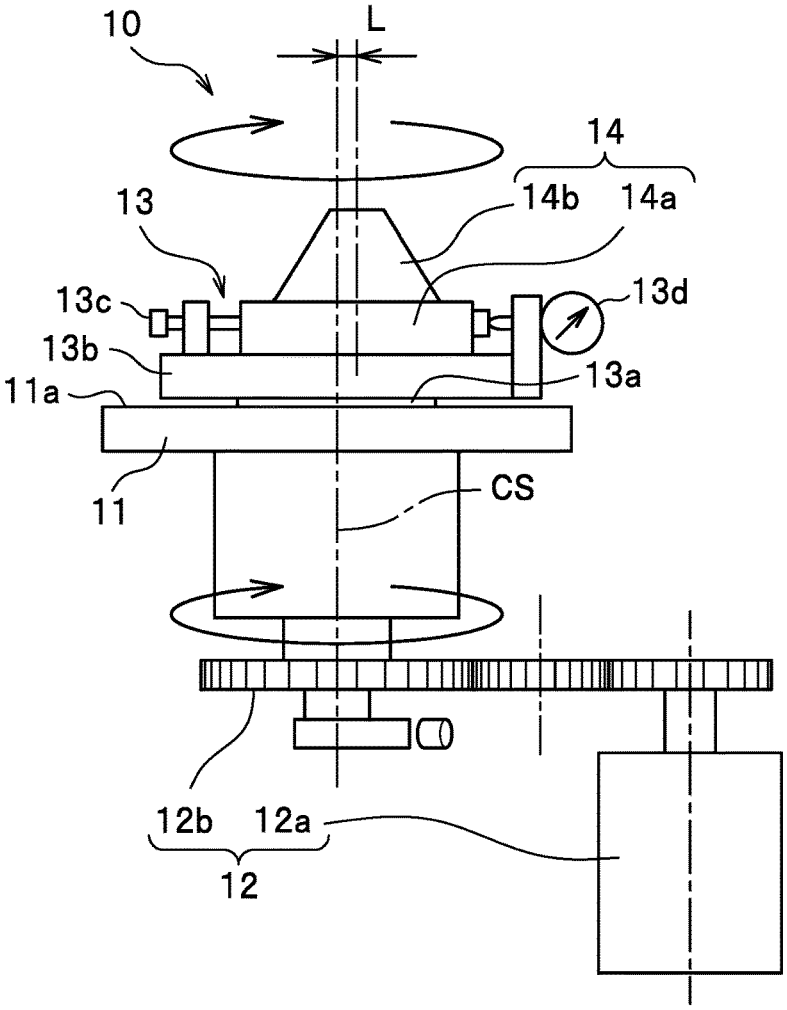
FIG. 8 is a front view illustrating an end portion support structure.
Figure 9:
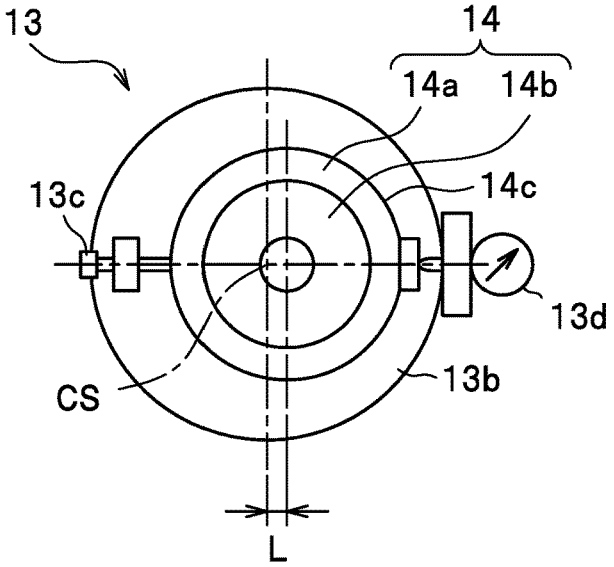
FIG. 9 is a plan view illustrating the end portion support structure.

Next, the end portion support structure 10 will be described (see FIGS. 8 and 9).

The end portion support structure 10 includes a rotating table 11, a rotating table drive unit (rotating unit) 12, an eccentric mechanism 13, and a workpiece support 14.

In the rotating table 11, a table surface 11*a* facing vertically upward is arranged so as to be rotatable about the machining central axis CS.

The rotating table 11 includes a dog (lath dog) (not shown) that synchronizes the rotation of the shaft workpiece W with the rotation of the workpiece support 14 on the machining central axis CS.

In the present embodiment, the shaft workpiece W is supported by the workpiece support 14, and is rotated synchronously therewith by the dog (lath dog).

The rotating table drive unit (rotating unit) 12 is configured to apply a rotational force to the rotating table 11.

The rotating table drive unit 12 includes a rotating table motor 12*a* as a drive source and a rotating table speed reduction mechanism 12*b* that reduces the rotational speed of the rotating table motor 12*a*.

The rotational speed of the rotating table motor 12*a* is controlled by an inverter (not shown).

The eccentric mechanism 13 is configured to fix the workpiece support 14 in a state of being eccentric with respect to the machining central axis CS.

The eccentric mechanism 13 is fixed on the table surface 11*a* of the rotating table 11 and rotates together with a rotating plate 13*b*.

The eccentric mechanism 13 includes the rotating plate 13*b*, a rotating shaft 13*a*, an adjustment screw 13*c*, and a dial gauge 13*d*.

The rotating plate 13*b* has a disk shape, and is arranged on the table surface 11*a* of the rotating table 11.

The rotating plate 13*b* is formed integrally with the rotating shaft 13*a*.

The rotating shaft 13*a* has a columnar shape, and is assembled such that a central axis thereof coincides with the machining central axis CS.

The adjustment screw 13*c* is assembled on the rotating plate 13*b*, and is configured to move the workpiece support 14 to adjust an eccentric dimension L by turning of the screw.

The adjustment screw 13*c* is arranged on the rotating plate 13*b* along the radial direction centered on the central axis of the rotating plate 13*b*.

By turning the adjustment screw 13*c*, the workpiece support 14 moves on the rotating plate 13*b*.

Therefore, the workpiece support 14 can be arranged concentrically with the machining central axis CS and can be arranged eccentrically with respect to the machining central axis CS. The dial gauge 13*d* is arranged on a side opposite to a side on which one adjustment screw 13*c* is arranged, and enables the eccentric dimension L to be set with higher accuracy.

The workpiece support 14 is configured to support a lower end side (opposite end side) of the shaft workpiece W from below.

The workpiece support 14 is arranged on the rotating table 11.

The workpiece support 14 includes a support base 14*a* and a support body 14*b*.

The support base 14*a* has a disk shape with a plate thickness, and the adjustment screw 13*c* is assembled to a circumferential surface 14*c*.

The support body 14*b* has a truncated cone shape, and is formed integrally with the support base 14*a* and concentrically with the support base 14*a*.

Next, the shaft portion support structure 20 will be described (see FIGS. 2 to 7).

The shaft portion support structure 20 has a structure for supporting the shaft support portion W1 of the shaft workpiece W, and is arranged at the column S2.

The shaft portion support structure 20 supports the shaft support portion W1 such that the workpiece central axis CW of the shaft support portion W1 to be supported coincides with or intersects the machining central axis CS of the center shaft machining apparatus S.

The shaft portion support structure 20 includes a centering mechanism 21 and a clamp mechanism (not shown).

Figure 7:
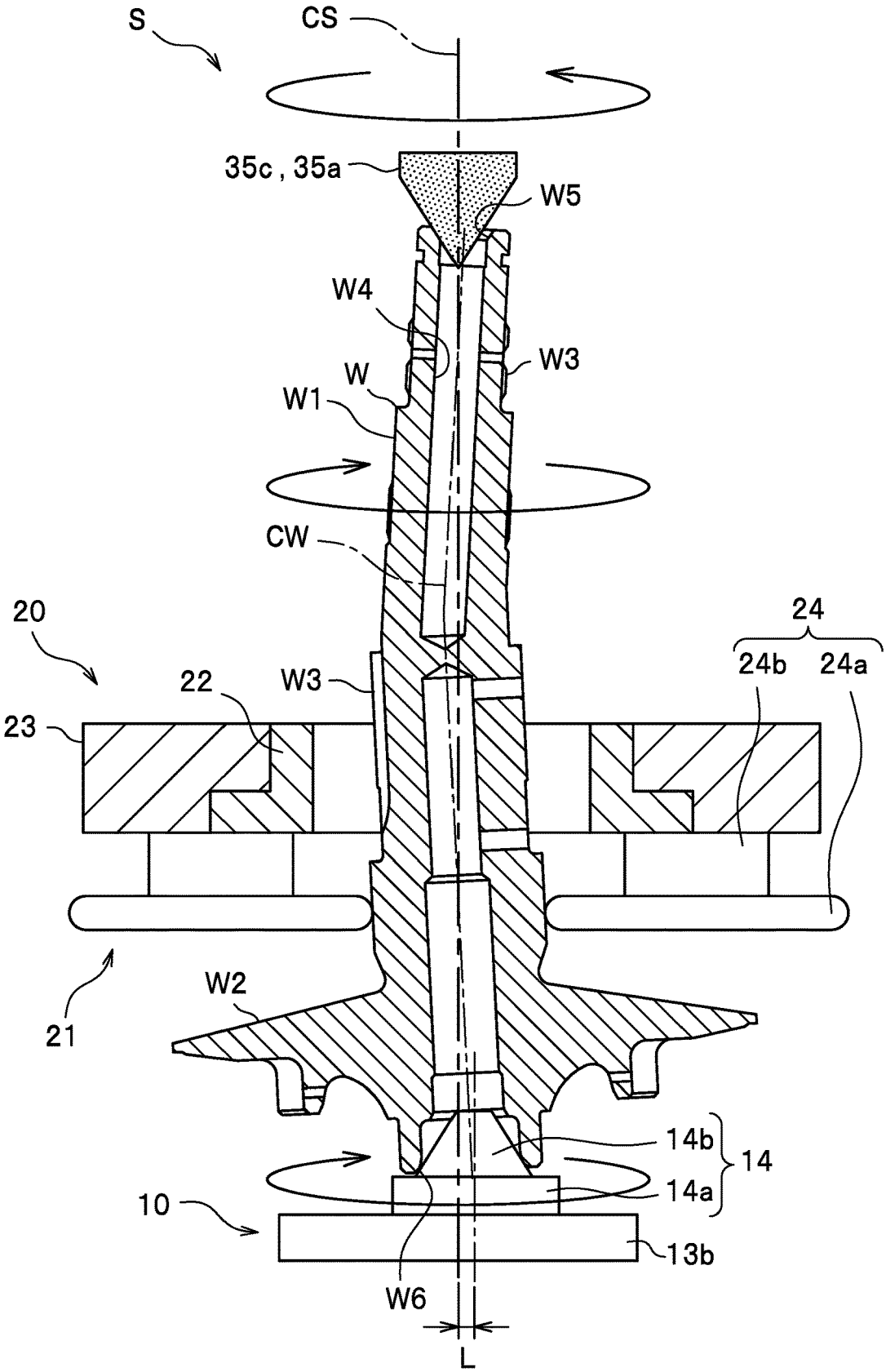
FIG. 7 is an enlarged cross-sectional view of the main parts illustrating how the upper end surface of the shaft workpiece is reconstructed in a state where a shaft portion support structure is inverted.

In addition, the shaft portion support structure 20 is unitized so as to be capable of being installed vertically inverted on the center shaft machining apparatus S (see FIG. 7).

As illustrated in FIG. 2, the centering mechanism 21 is configured to hold the shaft workpiece W in the machining space SA of the center shaft machining apparatus S.

Figure 5:
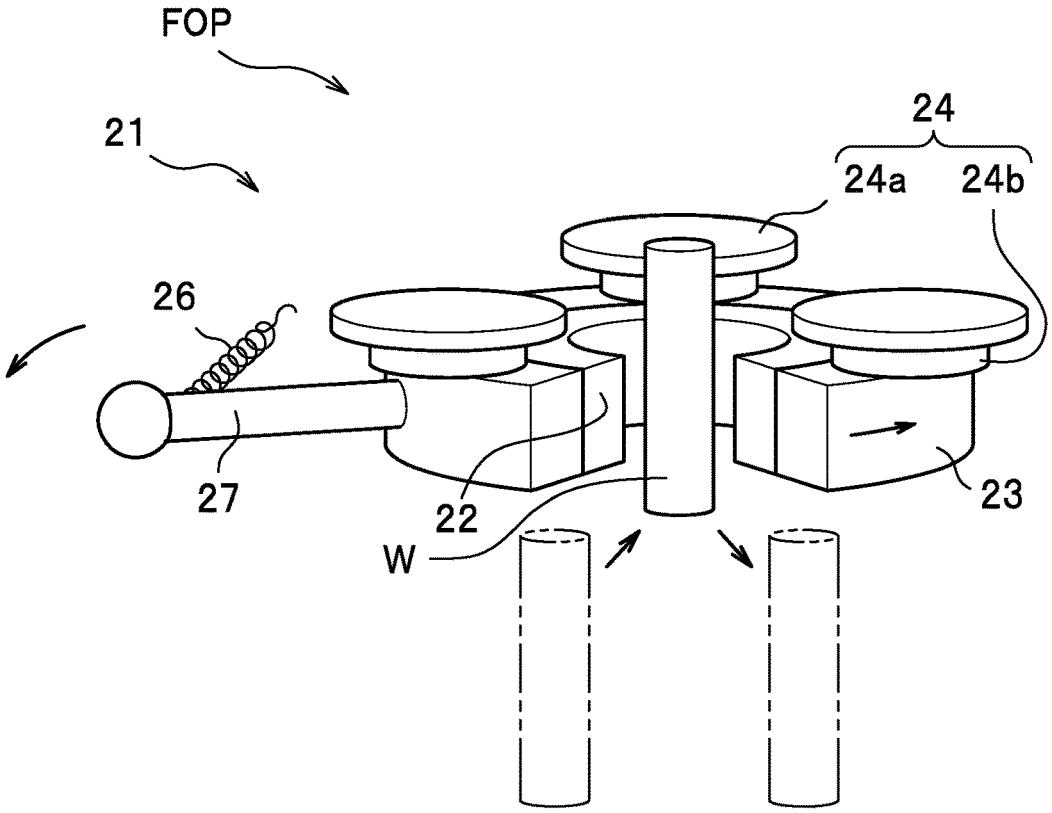
FIG. 5 is a perspective view illustrating a centering mechanism in an open form.

The centering mechanism 21 is transformed into a support form FCL (see FIGS. 3 and 6) and an open form FOP (see FIG. 5).

In the support form FCL, the shaft workpiece W is arranged on the machining central axis CS and is supported in a state where the opening W5 can be machined.

In the open form FOP, the shaft workpiece W is released, which enables the shaft workpiece W to be carried in from or carried out to the outside of the center shaft machining apparatus S.

The centering mechanism 21 includes a fixed base 22 (base member), a movable base 23 (base member), clamp rollers 24 (abutting units), swing cams 25, a temporary clamp spring 26, and an operation lever 27.

The fixed base 22 constitutes a base member. The fixed base 22 has substantially an L-shaped cross section and is made of an annular member centered on the machining central axis CS. A part of the annular member is cut out, so that the fixed base 22 is formed in substantially a C shape in plan view (see FIGS. 3 and 4).

The movable base 23 constitutes a base member, is made of an annular member slightly larger than the fixed base 22 while having substantially an L-shaped cross section, and is formed in substantially a C-shape in plan view, the C-shape being obtained by cutting out a part of the annular member.

The movable base 23 is arranged such that an inside of the L shape thereof overlaps an inside of the L shape of the fixed base 22 so as to facing each other, and that the movable base 23 is rotatable on the outer periphery of the fixed base 22 along the circumferential direction.

The clamp rollers 24 (abutting units) are configured to support the shaft workpiece W rotatably about the machining central axis CS.

The clamp rollers 24 each include a roller body 24*a* and a roller base 24*b*.

The roller body 24*a* is pivotally supported by the roller base 24*b* with being rotatable about a roller shaft 24*c* arranged in parallel with the machining central axis CS.

The roller body 24*a* has a disk shape, and a peripheral edge portion thereof is formed to have an arcuate cross section.

Since the peripheral edge portion is formed to have an arcuate cross section, the shaft workpiece W can be supported even when it is inclined.

The roller base 24*b* is pivotally supported by the fixed base 22 with being swingable on a C-shaped surface about a roller swing shaft 25*a* erected on the C-shaped surface of the fixed base 22.

That is, the roller body 24*a* is supported so as to be capable of approaching, separating from, and rotating about the machining central axis CS.

Three clamp rollers 24 having the above configuration are arranged as abutting units on the fixed base 22 at equiangular intervals (intervals of 120 degrees) about the machining central axis CS.

The swing cams 25 are each configured to convert a rotation operation of the movable base 23 into a swing operation of the roller body 24*a*, and one swing cam is arranged for each clamp roller 24.

The swing cams 25 each include a cam pin 25*b* and a cam groove 25*c*.

The cam pin 25*b* is made of a columnar member, and protrudes from the roller base 24*b* toward the cam groove 25*c* of the movable base 23.

The cam groove 25*c* is formed in the C-shaped surface of the movable base 23 and is constituted with a groove having a rectangular cross section.

In addition, the cam groove 25*c* extends so as to obliquely intersect a straight line extending on the C-shaped surface of the movable base 23 in the radial direction (diameter of the movable base 23).

The groove width of the cam groove 25*c* is set to the same dimension as the diameter of the cam pin 25*b*.

As a result, the cam pin 25*b* can move in the cam groove 25*c* without backlash.

The temporary clamp spring (biasing unit) 26 is a biasing unit for holding the support form FCL so that the centering mechanism 21 does not inadvertently shift from the support form FCL to the open form FOP.

As a result, even when an operator releases the operation lever 27, the shaft workpiece W is held in a supported state without dropping off or falling down.

The biasing force of the temporary clamp spring 26 is set to such a magnitude that the shaft workpiece W does not fall down and is held on the machining central axis CS, and the operator can perform a transformation operation from the support form FCL to the open form FOP.

The operation lever 27 is a lever operated by the operator when the support form FCL is transformed into the open form FOP.

<Transformation from Support Form FCL to Open Form FOP>

Figure 3:
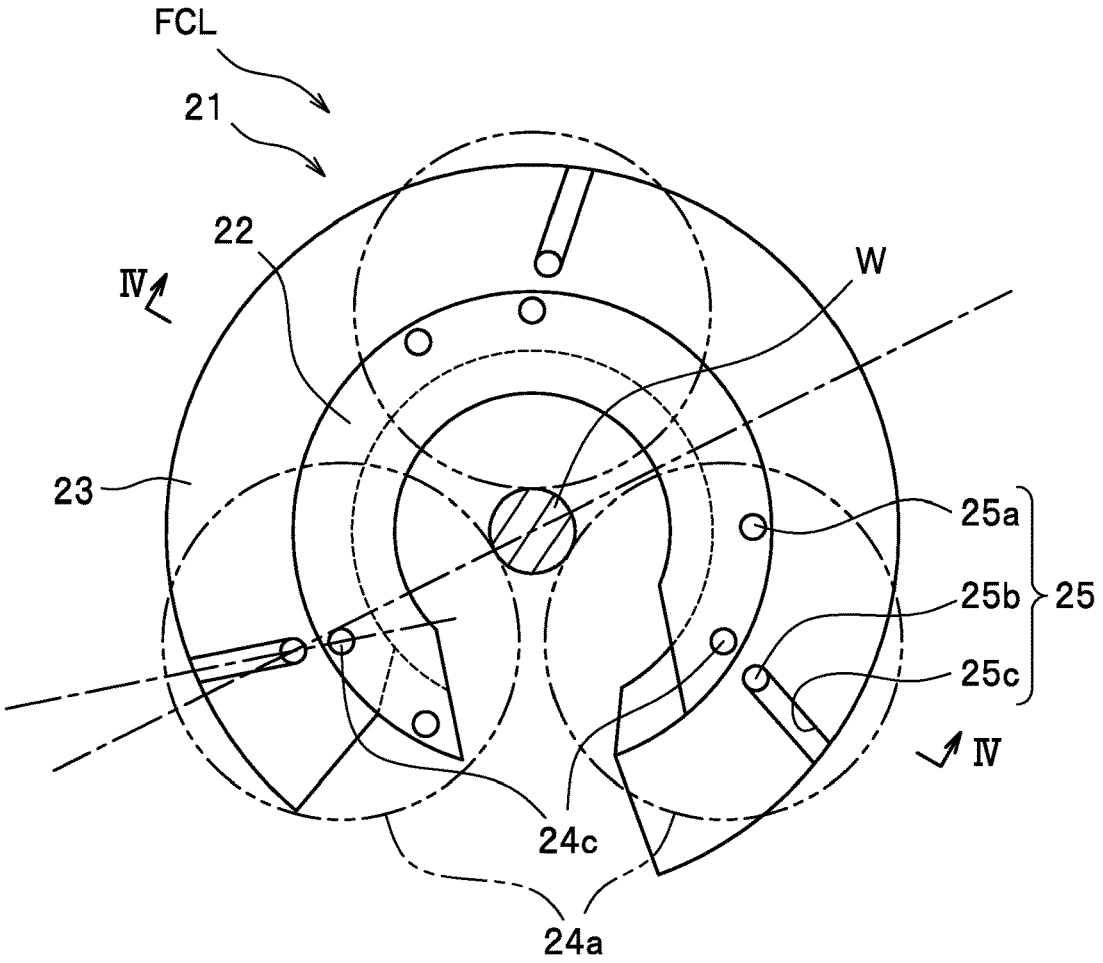
FIG. 3 is a cross-sectional view taken along line in FIG. 6.
Figure 4:
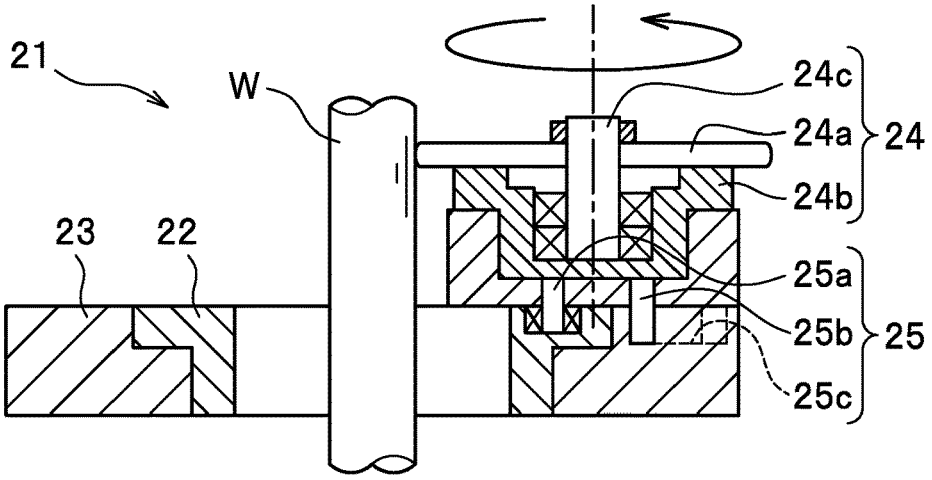
FIG. 4 is a cross-sectional view taken along line IV-IV of FIG. 3.
Figure 6:
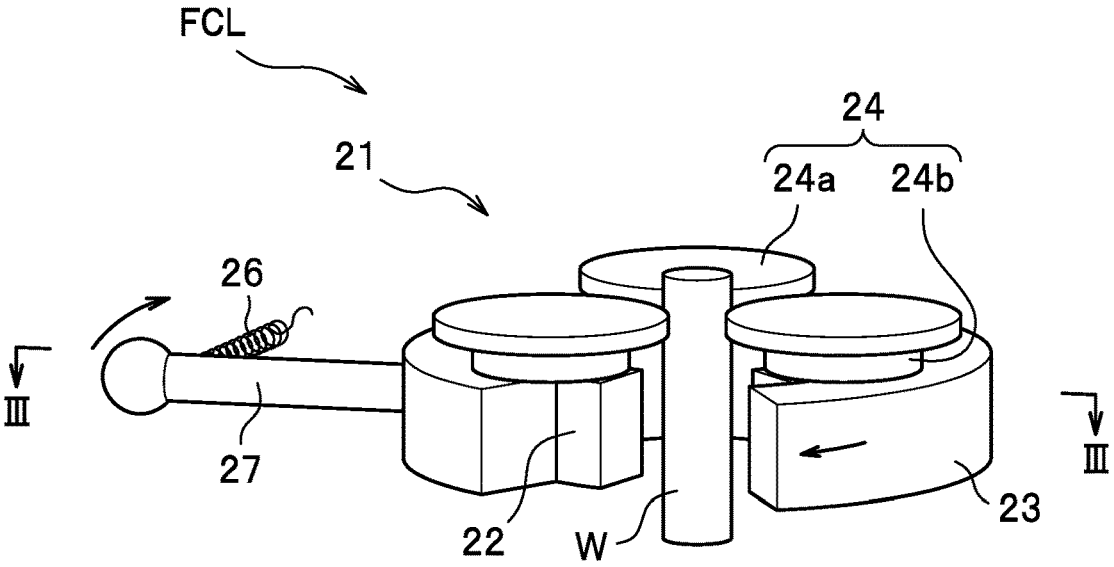
FIG. 6 is a perspective view illustrating the centering mechanism in a support form.

As seen in FIGS. 3, 5, and 6, in the support form FCL, when the operator operates the operation lever 27 in the counterclockwise direction, the movable base 23 rotates counterclockwise.

As the movable base 23 rotates counterclockwise, each cam pin 25*b* moves, in the cam groove 25*c*, from an inside end in the radial direction to an outside end in the radial direction.

By the movement of each cam pin 25*b* to the outside end in the radial direction, the roller base 24*b* on which the cam pin 25*b* is erected swings about the roller swing shaft 25*a* in a direction away from the machining central axis CS (from the inside to the outside in the radial direction).

As each of the roller bases 24*b* swings from the inner side to the outer side in the radial direction, the roller bodies 24*a* are separated from one another and shift to the open form FOP.

When the roller bodies 24*a* are separated from one another, the shaft workpiece W can be advanced onto and retracted from the machining central axis CS.

<Transformation from Open Form FOP to Support Form FCL>

In the open form FOP, when the operator releases the operation lever 27, the movable base 23 rotates clockwise by the biasing force of the temporary clamp spring 26.

As the movable base 23 rotates clockwise, each cam pin 25*b* moves, in the cam groove 25*c*, from the outside end in the radial direction to the inside end in the radial direction. By the movement of each cam pin 25*b* to the inside end in the radial direction, the roller base 24*b* on which the cam pin 25*b* is erected swings about the roller swing shaft 25*a* in a direction toward the machining central axis CS (from the outside to the inside in the radial direction).

As each of the roller bases 24*b* swings from the outside to the inside in the radial direction, the roller bodies 24*a* come close to one another and shift to the support form FCL.

Since the roller bodies 24*a* come close to one another by the biasing force of the temporary clamp spring 26, the shaft workpiece W is supported on the machining central axis CS in a state where the operator keeps his/her hand off the operation lever 27.

The clamp mechanism is configured to prevent the shaft workpiece W from deviating or moving from the machining central axis CS while enabling the shaft workpiece W to rotate about the machining central axis CS during machining of the opening W5.

That is, the clamp mechanism is configured to prevent the shift from the support form FCL to the open form FOP.

The clamp mechanism includes a pressurizing unit and a wedge unit.

The pressurizing unit is configured to press the roller bodies 24*a* against the shaft workpiece W with a predetermined magnitude of force in the support form FCL, and includes a so-called pneumatic cylinder.

In FIG. 3, the pressurizing unit is arranged so as to restrict the movement of the movable base 23 in the counterclockwise direction at the time of pressurization.

That is, the pressure generated by the pressurizing unit acts on the roller bases 24*b* and the roller bodies 24*a* via the swing cams 25.

The wedge unit is configured to hold and fix the clamp rollers 24 at the positions thereof in the support form FCL.

The wedge unit moves in parallel to the machining central axis CS and engages with the movable base 23 so as to restrict the rotation of the movable base 23 in the clockwise direction in FIG. 3 in the support form FCL.

That is, a force for displacing the roller bodies 24*a* to the outside in the radial direction during the machining of the center hole W4 acts on the wedge unit via the swing cams 25.

The center shaft machining apparatus S according to the present embodiment is configured such that the force of the clamp mechanism acts via the swing cams 25, but is not limited to such a configuration.

For example, a configuration can be employed in which the force of the clamp mechanism acts on the roller bases 24*b*, and working effects similar to those of the present embodiment can be obtained.

The shaft portion support structure 20 having the above configuration is unitized, and as illustrated in FIG. 7, in a vertically inverted state, can support the shaft workpiece W while centering the shaft workpiece W on the machining central axis CS.

As a result, center hole machining can be performed on the shaft workpieces W of various forms.

Figure 10:
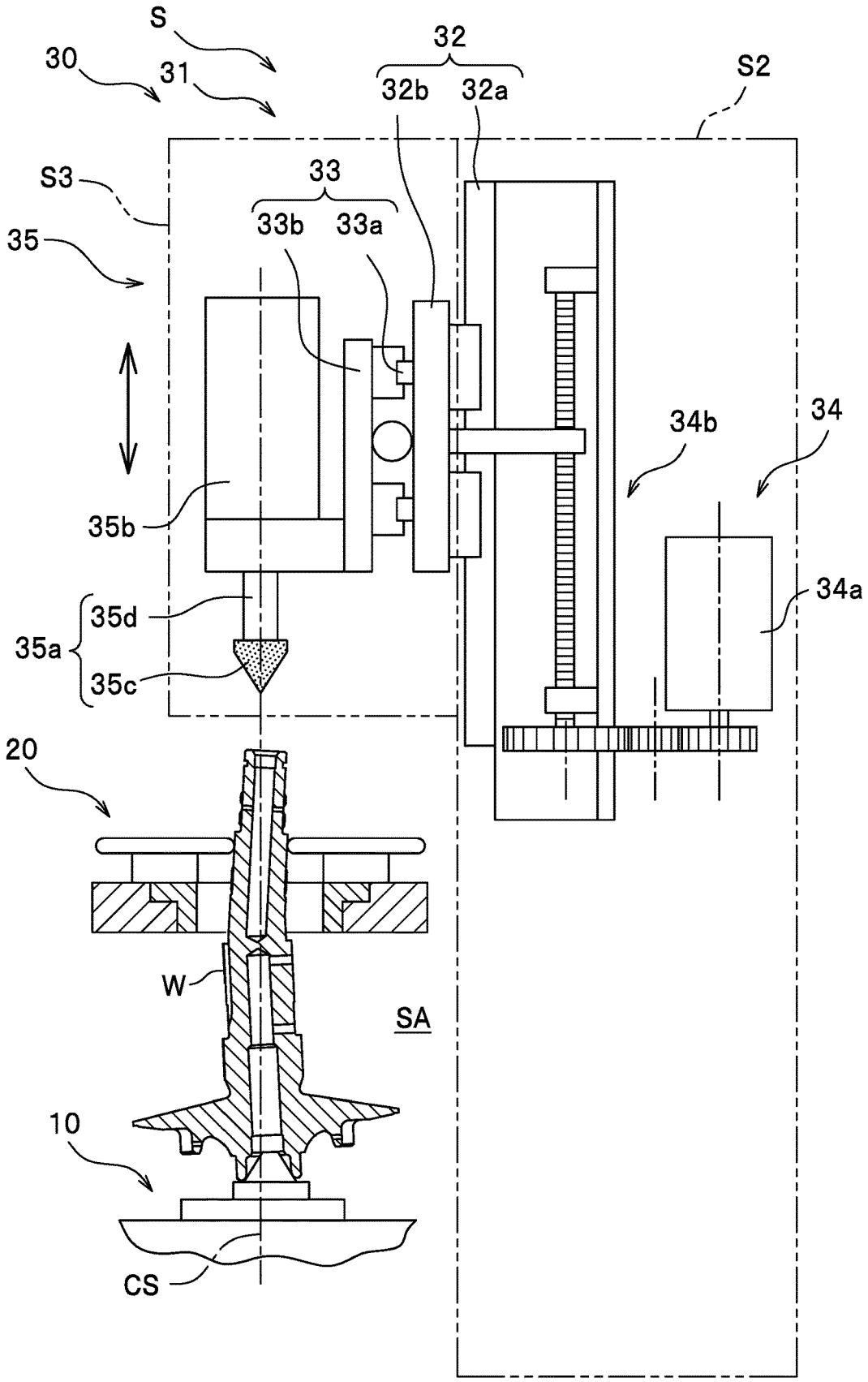
FIG. 10 is a side view illustrating a grinding structure.
Figure 11:
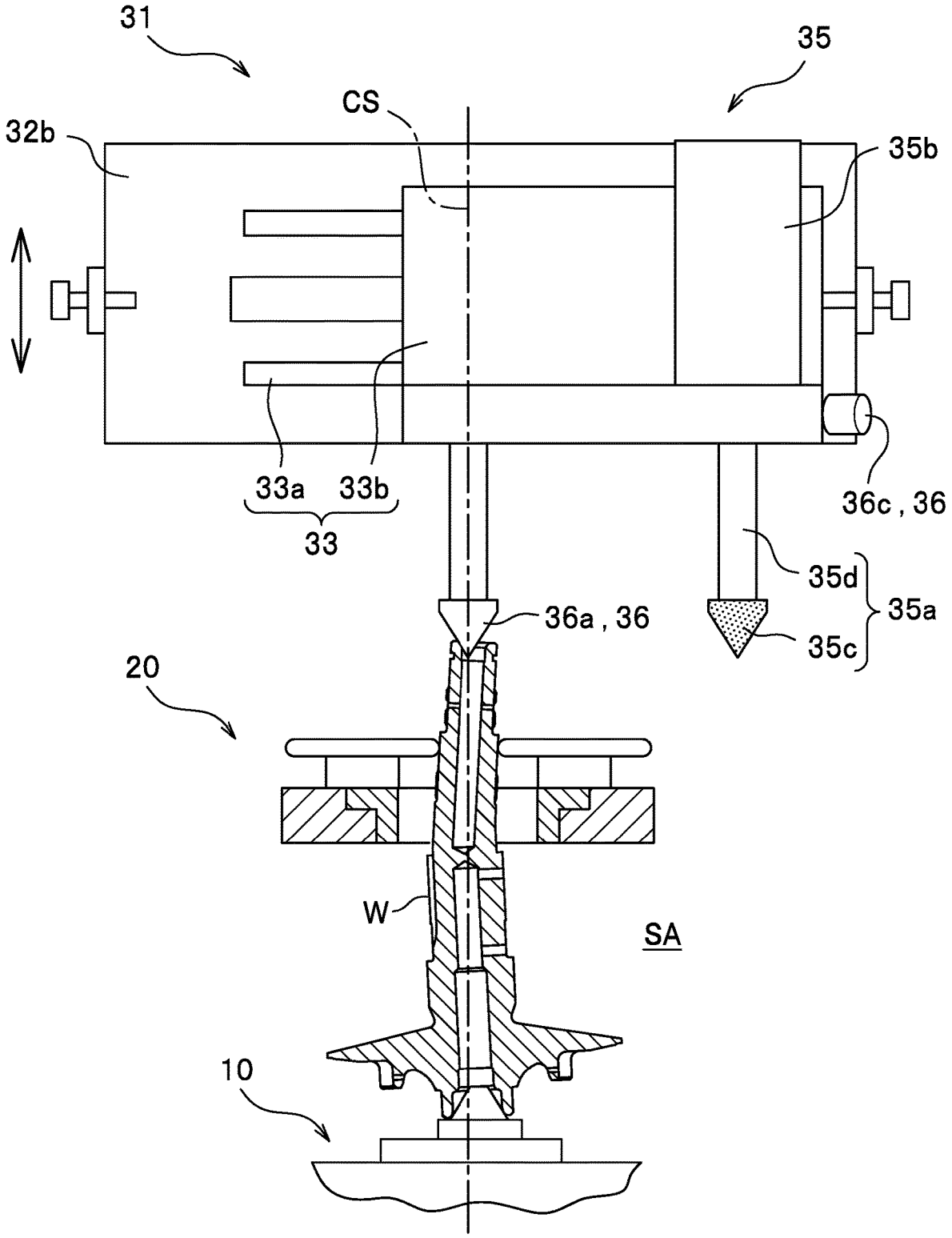
FIG. 11 is a front view illustrating how the position of an end surface is calibrated before the grinding structure reconstructs the end surface.
Figure 12:
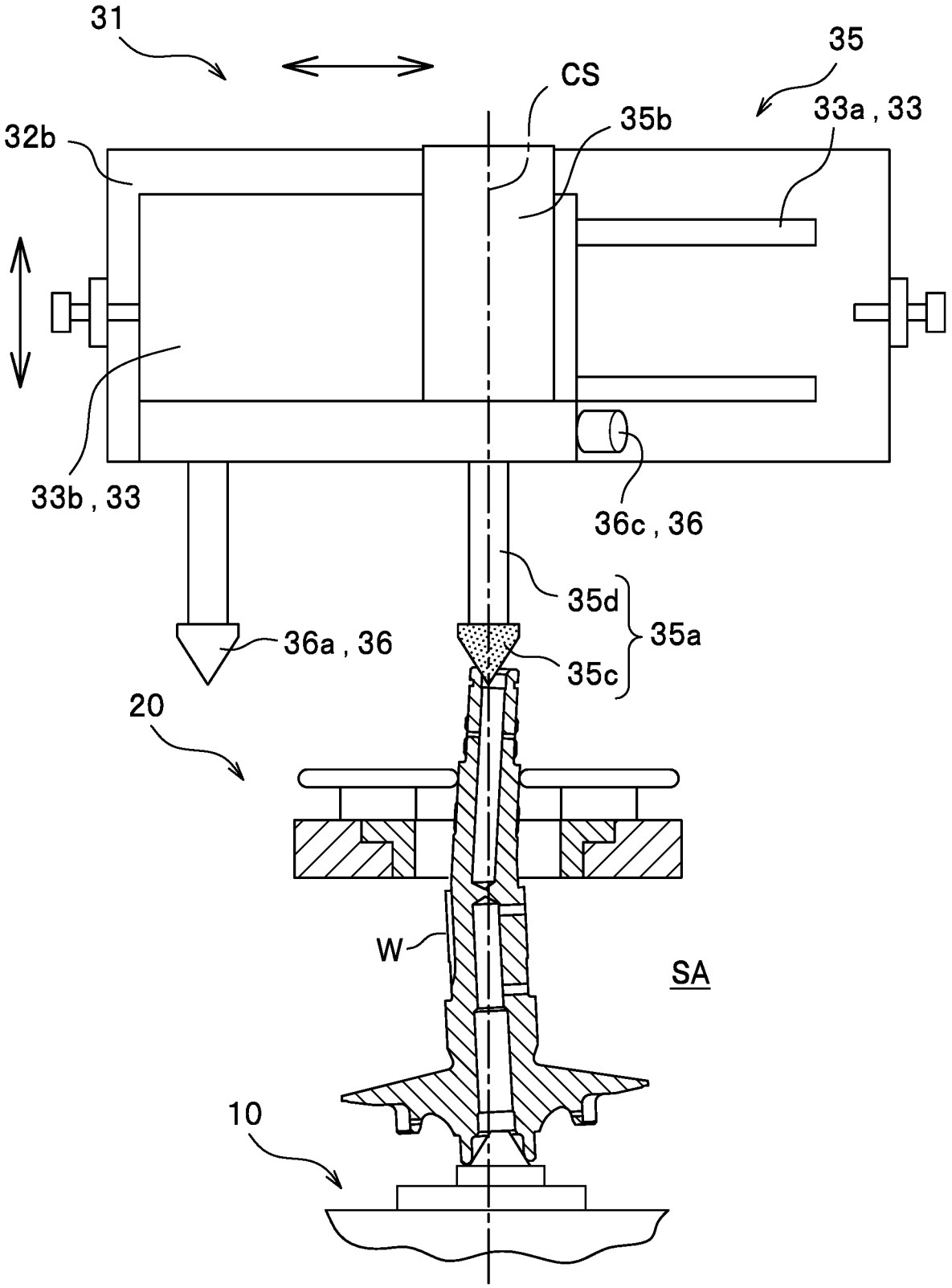
FIG. 12 is a front view illustrating how the grinding structure reconstructs the end surface.

Next, the grinding structure 30 will be described (see FIGS. 10 to 12).

The grinding structure 30 is configured to perform grinding machining and cutting machining.

The grinding structure 30 includes a feed mechanism 31, a headstock 35, and a determination unit 36.

The feed mechanism 31 is configured to move the headstock 35 to a predetermined position.

The feed mechanism 31 includes a lift feed unit 32, a horizontal feed unit 33, and a feed drive unit 34.

The lift feed unit 32 is configured to move up and down the headstock 35, and includes a lift rail 32*a* and a lift base 32*b*.

The lift rail 32*a* is arranged on the column S2 along the vertical direction.

The lift base 32*b* is arranged so as to be smoothly movable on the lift rail 32*a*.

The horizontal feed unit 33 is configured to move the headstock 35 in the horizontal direction, and includes horizontal rails 33*a* and a horizontal base 33*b*.

The horizontal rails 33*a* are arranged on the lift base 32*b* along the horizontal direction.

The horizontal base 33*b* is arranged so as to be smoothly movable on the horizontal rails 33*a*.

The feed drive unit 34 is configured to move the vertical position of the lift base 32*b* and the position of the horizontal base 33*b* in the horizontal direction to any positions.

The feed drive unit 34 includes a gear mechanism 34*b* that uses, as a drive source, a feed motor 34*a* including a servo motor.

The headstock 35 is configured to perform machining on the shaft workpiece W, and is arranged on the horizontal base 33*b*.

That is, the headstock 35 is arranged so as to be movable up and down and reciprocatable in the horizontal direction on the column S2 by the lift feed unit 32, the horizontal feed unit 33, and the feed drive unit 34.

The headstock 35 includes a grinding tool 35*a* and a spindle drive unit 35*b*.

The grinding tool 35*a* is configured to actually grind an upper end surface (opening W5) of the shaft workpiece W.

The grinding tool 35*a* includes a grindstone 35*c* and a support shaft 35*d*.

The grindstone 35*c* has a conical shape.

The support shaft 35*d* extends on the central axis of the grindstone 35*c*, and has a columnar shape.

The spindle drive unit 35*b* includes a belt transmission mechanism (not shown) using, as a drive source, a spindle motor (not shown) including a three-phase motor.

The determination unit 36 includes a contactor 36*a*, an acoustic emission (AE) sensor 36*c*, and a determination control unit (not shown).

The contactor 36*a* is set to have the same outer shape as the grindstone 35*c*.

The AE sensor 36*c* is a sensor using a piezoelectric element, and is installed on the horizontal base 33*b*.

The AE sensor 36*c* determines a grinding state from sound and vibration transmitted from the grindstone 35*c* to the horizontal base 33*b* during the grinding machining.

The determination control unit measures the feed amount of the lift feed unit 32 and an output signal of the AE sensor 36*c*, and ends the feeding when a set grinding amount is reached.

<Machining Procedure>

A procedure for reconstructing the workpiece central axis CW of the shaft workpiece W using the center shaft machining apparatus S will be described.

First, the operator adjusts the adjustment screw 13*c* of the eccentric mechanism 13 to set the eccentric amount of the workpiece support 14 to the eccentric dimension L.

Next, the operator adjusts the height of the shaft portion support structure 20, and performs setting such that the roller bodies 24*a* sandwich the shaft support portion W1 of the shaft workpiece W in the support form FCL.

The eccentric dimension L is appropriately determined depending on the distortion of each shaft workpiece W.

This is because the magnitude of distortion caused by quenching varies from one shaft workpiece W to another.

Next, the operator operates the operation lever 27 to keep the shaft portion support structure 20 in the open form FOP, and in that state, arranges the shaft workpiece W in the machining space SA while fitting the workpiece support 14 into a lower opening W6 of the shaft workpiece W.

The operator releases the operation lever 27 while aligning the shaft support portion W1 of the shaft workpiece W with the machining central axis CS.

When the operator releases the operation lever 27, the shaft portion support structure 20 shifts from the open form FOP to the support form FCL by the biasing force of the temporary clamp spring 26, and the shaft workpiece W is held in the machining space SA.

The operator operates a control panel to set the rotational speed, the feed speed, and the feed amount of the grinding tool 35*a*, and the rotational speed of the rotating table 11.

When the operator presses two-hand control switches, an automatic operation is started, and the pressurizing unit and the wedge unit of the clamp mechanism operate to lock the shaft portion support structure 20.

After the start of the grinding machining, the center shaft machining apparatus S first abuts the contactor 36*a* against the upper end surface (end surface of one end) of the shaft workpiece W to measure the position (height) of the upper end surface of the shaft workpiece W.

Next, the horizontal feed unit 33 moves the grindstone 35*c* onto the machining central axis CS.

Next, the spindle drive unit 35*b* rotates the shaft workpiece W at a predetermined rotational speed while rotating the grindstone 35*c* at a predetermined rotational speed.

When the respective rotations are stabilized, the lift feed unit 32 lowers the grindstone 35*c* at a predetermined feed speed.

When the determination control unit determines that the grinding operation has been completed from the feed amount of the lift feed unit 32 and the output signal of the AE sensor 36*c*, the determination control unit ends the feeding of the grindstone 35*c*.

When the lock of the clamp mechanism is released, the automatic operation is completed, and the operator operates the operation lever 27 to take out the shaft workpiece W from the center shaft machining apparatus S, and the work is completed.

<Operational Effects>

The center shaft machining apparatus S according to the present embodiment includes the grinding structure 30 that moves on the machining central axis CS while rotating about the machining central axis CS and machines, along the machining central axis CS, an end surface of one end of the shaft workpiece W (workpiece) arranged on the machining central axis CS.

The center shaft machining apparatus S further includes the end portion support structure 10 that supports an opposite end side of the shaft workpiece W, and the shaft portion support structure 20 that supports the shaft support portion W1 of the shaft workpiece W.

The end portion support structure 10 includes the eccentric mechanism 13 capable of supporting the opposite end of the shaft workpiece W in a state where the workpiece central axis CW of the shaft workpiece W is eccentric with respect to the machining central axis CS.

With such a configuration, it is possible to improve the quality and the yield of the shaft workpiece W (workpiece) which is formed into a product shape and then quenched, such as a pulley shaft.

That is, a new conical surface is formed on the end surface of the shaft workpiece W, and a straight line connecting the center of the new conical surface and the center of the lower opening W6 is reconstructed as a new workpiece central axis CW, and thereby the center hole can be optimized, and a workpiece that is slightly out of tolerance can be made to fall within the tolerance.

Furthermore, in the present embodiment, the shaft portion support structure 20 includes three clamp rollers (abutting units) 24 arranged so as to be capable of abutting on the shaft support portion W1 while being arranged at equiangular intervals about the machining central axis CS and radially movable about the machining central axis CS.

As a result, attaching and detaching work of the shaft workpiece W to and from the center shaft machining apparatus S is simplified, and the workability at the time of reconstructing the workpiece central axis CW can be improved.

In the shaft portion support structure 20 according to the present embodiment, the three clamp rollers 24 are arranged at equiangular intervals, but there is no limitation to such a configuration.

For example, a configuration including four clamp rollers 24 is also possible.

In a case of such a configuration, the clamp rollers 24 adjacent to each other are arranged in an axially offset manner, and the opposite clamp rollers 24 facing each other with the shaft workpiece W interposed therebetween are arranged in an axially aligned manner.

With this arrangement, even when the diameters of the adjacent roller bodies 24*a* are set to be large, the roller bodies 24*a* can support the shaft support portion W1 without interfering with each other.

By increasing the diameters of the roller bodies 24*a* to increase the diameter of the centering mechanism 21, interference between the pulley portion W2 and the centering mechanism 21 can be prevented.

As a result, it is not necessary to make the shaft portion support structure 20 vertically invertible, and workability can be further improved.

In the present embodiment, each clamp roller (abutting unit) 24 is biased and held radially inward toward the machining central axis CS using the temporary clamp spring 26.

With such a configuration, the operator can move away from the shaft workpiece W while the shaft workpiece W is temporarily held in the machining space SA.

As a result, it is not necessary to arrange another operator for fine adjustment of each component or the like, and workability can be improved.

Furthermore, in the present embodiment, each clamp roller (abutting unit) 24 is arranged on the C-shaped surface of the fixed base (base member) 22 and the movable base (base member) 23 each having substantially a C-shape in plan view.

With such a configuration, the shaft workpiece W can be taken in and out from the machining space SA through a cut-out portion in the C-shape of each of the fixed base 22 and the movable base 23 (see FIG. 5).

As a result, it is possible to improve workability when the shaft workpiece W is taken in and out from the machining space SA.

On the other hand, in a case where the fixed base 22 and the movable base 23 have an annular shape, it is necessary to provide a work space by lifting or lowering the shaft portion support structure 20 when the shaft workpiece W is taken in and out from the machining space.

In addition, since it is necessary to place the shaft workpiece W inside the annulus of the fixed base 22 and the movable base 23 without damaging the shaft workpiece W, the operator needs to pay careful attention.

In the present embodiment, the shaft portion support structure 20 is unitized so as to be vertically invertible.

With such a configuration, even when the shaft support portion W1 is positioned in the vicinity of the pulley portion W2, the shaft support portion W1 can be supported without interfering with the pulley portion W2.

In addition, since the diameters of the roller bodies 24*a* of the clamp rollers 24 can be reduced, the apparatus as a whole can be downsized.

In the present embodiment, the end portion support structure 10 includes the rotating table drive unit (rotating unit) 12 that rotates the eccentric mechanism 13 about the machining central axis CS.

The shaft portion support structure 20 supports the shaft support portion W1 (portion) where the workpiece central axis CW intersects the machining central axis CS such that the shaft workpiece W is rotatable about the machining central axis CS.

With such a configuration and by performing grinding machining by setting the rotational speed of the rotating table 11 and the rotational speed of the grinding tool 35*a*, it is possible to more appropriately adjust the shape of an end surface to be reconstructed.

In the center shaft machining apparatus S according to the present embodiment, the shaft workpiece W is rotated at the time of re-machining the opening W5, but there is no limitation to such a machining mode.

For example, it is also possible to adopt a machining mode in which the shaft workpiece W is not rotated while being eccentric but fixed, and only the grinding tool 35*a* is rotated to grind the upper end surface of the shaft workpiece W.

Similarly, it is also possible to adopt a machining mode in which the shaft workpiece W is rotated while being eccentric, and the grinding tool 35*a* is not rotated and only downward feed thereof is performed.

That is, it is also possible to adopt a configuration in which only one of the grinding tool 35*a* and the shaft workpiece W is rotated to perform grinding machining, and working effects similar to those of the present embodiment can be obtained.

In the present embodiment, the grinding structure 30 includes the AE sensor 36*c* that detects sound and vibration during grinding machining, and the determination control unit that determines a grinding state from an output signal of the AE sensor 36*c*.

With such a configuration, grinding end timing can be determined not only by the feed amount of the lift feed unit 32 but also by sound and vibration.

As a result, it is possible to know the grinding state, and to finish the end surface to be reconstructed more smoothly.

In addition, sound and vibration during the grinding operation can be fed back to the rotational speed and feed speed of the grinding tool 35*a*, and thereby grinding can be performed at more appropriate rotational speed and feed speed.

As a result, a ground surface can be finished more favorably, and the life of the grinding tool 35*a* can be prolonged.

In the present embodiment, the new conical surface is formed on the upper end surface of the shaft workpiece W, and the straight line connecting the center of the new conical surface and the center of the lower opening W6 is reconstructed as a new workpiece central axis CW, but there is no limitation thereto.

For example, it is also possible to form new conical surfaces at both ends of the shaft workpiece W and to reconstruct a straight line connecting the centers of both the conical surfaces as a new workpiece central axis CW.

As a result, it is possible to cope with a large distortion that does not fall within tolerance even when a new conical surface is formed on one end surface and a new workpiece central axis CW is reconstructed.

What is claimed is:

1. A center shaft machining apparatus for re-machining a shaft workpiece formed as a rotating body centered around a workpiece central axis, the shaft workpiece including:

a first end portion having a first opening, a second end portion opposite to the first end portion, and having a second opening, an intermediate portion located between the first end portion and the second end portion, the first end portion, the second end portion, and the intermediate portion being located along the workpiece central axis, wherein the shaft workpiece includes a distortion with respect to the workpiece central axis such that a center of the first opening does not coincide with a center of the second opening, the center shaft machining apparatus comprising:

a grinding structure that moves along a machining central axis while rotating about the machining central axis and machines an end surface that defines the first opening of the first end portion of the shaft workpiece to form a machined first opening, the shaft workpiece being supported along the machining central axis;

an end support structure that supports the second end portion of the shaft workpiece; and an intermediate support structure that rotatably supports the intermediate portion of the shaft workpiece such that the workpiece central axis of the shaft workpiece coincides with or intersects the machining central axis, wherein the end support structure includes an eccentric mechanism capable of supporting the second end portion of the shaft workpiece in a state where the workpiece central axis is eccentric with respect to the machining central axis by an eccentric amount based on the distortion of the shaft workpiece with respect to the workpiece central axis, and a rotating unit that rotates the eccentric mechanism about the machining central axis, and wherein a straight line connecting a center of the machined first opening and the center of the second opening is reconstructed as a new workpiece central axis.

2. The center shaft machining apparatus according to claim 1, wherein the intermediate support structure includes three or more abutting units capable of abutting on the intermediate portion, the abutting units being arranged at equiangular intervals about the machining central axis and radially movable about the machining central axis.

3. The center shaft machining apparatus according to claim 2, wherein the abutting units are biased and held radially inward toward the machining central axis using a biasing unit.

4. The center shaft machining apparatus according to claim 2, wherein the abutting units are arranged on C-shaped surfaces of base members each having a C-shape in plan view.

5. The center shaft machining apparatus according to claim 1, wherein the intermediate support structure is configured to be vertically invertible between a normal posture where the intermediate portion is supported with the abutting units face upward toward the first end portion of the shaft workpiece and an inverted posture where the intermediate portion is supported with the abutting units face downward toward the second end portion of the shaft workpiece.

6. A center shaft machining apparatus for re-machining a shaft workpiece formed as a rotating body centered around a workpiece central axis, the shaft workpiece including:

a first end portion having a first opening, a second end portion opposite to the first end portion, and having a second opening, an intermediate portion located between the first end portion and the second end portion, the first end portion, the second end portion, and the intermediate portion being located along the workpiece central axis, wherein the shaft workpiece includes a distortion with respect to the workpiece central axis such that a center of the first opening does not coincide with a center of the second opening, the center shaft machining apparatus comprising:

a grinding structure that moves along a machining central axis while rotating about the machining central axis and machines an end surface that defines the first opening of the first end portion of the shaft workpiece to form a machined first opening, the shaft workpiece being supported along the machining central axis;

an end support structure that supports the second end portion of the shaft workpiece; and an intermediate support structure that rotatably supports the intermediate portion of the shaft workpiece such that the workpiece central axis of the shaft workpiece coincides with or intersects the machining central axis, wherein the end support structure includes an eccentric mechanism capable of supporting the second end portion of the shaft workpiece in a state where the workpiece central axis is eccentric with respect to the machining central axis by an eccentric amount based on the distortion of the shaft workpiece with respect to the workpiece central axis, and a rotating unit that rotates the eccentric mechanism about the machining central axis, wherein a straight line connecting a center of the machined first opening and the center of the second opening is reconstructed as a new workpiece central axis, and the grinding structure includes:

an AE sensor that detects sound and vibration during grinding machining; and a determination control unit that determines a grinding state from an output signal of the AE sensor.

* * * * *